United States Patent [19]

Stepánek et al.

[11] 3,961,499

[45] June 8, 1976

[54] MECHANISM FOR SUPPORTING NEEDLE CAMS ON KNITTING MACHINES

[75] Inventors: Bohumil Stepánek; Rudolf Bandoch, both of Brno, Czechoslovakia

[73] Assignee: Vyzkumny a vyvojovy ustav Zavodu vseobecneho strojirenstvi, Brno, Czechoslovakia

[22] Filed: Mar. 14, 1973

[21] Appl. No.: 341,266

[52] U.S. Cl. ..... 66/54; 66/57

[51] Int. Cl.[2] ..... D04B 9/00

[58] Field of Search ..... 66/54, 57, 42, 8, 78

[56] References Cited

UNITED STATES PATENTS

| | | | |
|---|---|---|---|
| 1,149,884 | 8/1915 | Ames | 66/57 |
| 1,424,725 | 8/1922 | Howie et al. | 66/23 |
| 2,823,529 | 2/1958 | St. Pierre et al. | 66/57 |
| 3,013,418 | 12/1961 | Hill | 66/57 |
| 3,148,518 | 9/1964 | Peel et al. | 66/57 |
| 3,299,673 | 1/1967 | Noll | 66/57 |
| 3,387,467 | 6/1968 | Beckenstein | 66/57 |
| 3,572,056 | 3/1971 | Radin | 66/57 |
| 3,854,305 | 12/1974 | Bandoch et al. | 66/54 |

FOREIGN PATENTS OR APPLICATIONS

| | | | |
|---|---|---|---|
| 561,644 | 9/1932 | Germany | 66/57 |
| 849,648 | 9/1960 | United Kingdom | 66/78 |

*Primary Examiner*—W.C. Reynolds
*Assistant Examiner*—A. M. Falik

[57] ABSTRACT

Mechanism for adjustably supporting needle cams on knitting machines, particularly on circular knitting machines. The mechanism provides simple means for adjusting the cams both in the direction of the knitting stroke of the needles in the slots of the needle cylinder, i.e. in the direction of height, and in the direction transverse to this knitting stroke in the horizontal plane along the periphery of the cam assembly frame plate, that is, in a lateral direction for the lateral adjustment of the cams and thus to eliminate the manufacturing deviations in the angular distribution of the knitting feeds. In accordance with the invention, the cam assembly is provided with a prismatic recess, in which there is mounted a block which is slidable laterally, that is, in a direction tangential to the needle cylinder, such lateral adjustment being provided by a spring and a screw with a conical end or by an eccentric pin. The sliding block is provided with a bore parallel to the axis of the needle cylinder, a pin being slidably mounted in the bore; affixed to the pin are a stitch cam and a stop cam, the pin being adjusted longitudinally of the bore by suitable means such as spring and screw with a conical end or an eccentric pin.

3 Claims, 3 Drawing Figures

MECHANISM FOR SUPPORTING NEEDLE CAMS ON KNITTING MACHINES

This application is related to application Ser. No. 341,036, filed of even date herewith by the same inventors and assigned to the same assignee, said related application being based upon Czechoslovakian Pat. Application Ser. No. PV 4833, filed July 1, 1971.

This invention relates to a cam assembly with cams for controlling the needles of knitting machines, particularly in circular knitting machines.

Cam assemblies hitherto known and circular knitting machines are distributed around the needle cylinder and comprise a mantle or cylindrical sleeve which is open in the axial direction, the batten or pin being mounted on the mantle for traverse and adjustment in the direction of movement of the knitting needles, the cams, usually a stitch cam and a stop cam, being attached to the batten or pin. Entrance and exit cam stop parts for guiding the knitting needles into and away from the stitch cams and the stop cams are also mounted in the cam assembly.

Cam assemblies hitherto known have the disadvantage that they permit the cams to be adjusted only in the direction of knitting movement of the knitting needles, this making possible a good adjustment of the equal stroke length of the knitting needles in all the knitting feeds. The expression "knitting movement of the needles" means the knitting stroke of the needles, that is, the vertical movement of the knitting needles in the needle groves of the needle cylinder with which the circular knitting machine is provided.

In multi-feed circular knitting machines, particularly machines with a fine gauge of the needle beds, it is also necessary to perform lateral adjustment of the cams and thus to eliminate the manufacturing deviations in the angular distribution of the knitting feeds in the mutually cooperating cylinder and dial systems of the knitting machine. Such deviations would otherwise result in irregularity in the alternate sinking of the knitting needles in various knitting feeds of the machine, and thus would provide irregular courses in the knit work formed by the machine.

The present invention has among its objects the overcoming of the above described disadvantages in the prior art cam supporting devices. In accordance with the invention, the cam assembly is provided with a prismatic recess, in which there is mounted a block which is slidable laterally, that is, in a direction tangential to the needle cylinder, such lateral adjustment being provided by a spring and a screw with a conical end or by an eccentric pin. The sliding block is provided with a bore parallel to the axis of the needle cylinder, a pin being slidably mounted in the bore; affixed to the pin are a stitch cam and a stop cam, the pin being adjusted longitudinally of the bore by suitable means such as spring and screw with a conical end or an eccentric pin.

The cam assembly of the invention has the advantage of making possible the adjustment of the cams in both directions, that is, parallel to the direction of knitting movement of the knitting needles and also laterally with respect to such first direction, thereby permitting the elimination of manufacturing deviations in the angular distribution of the knitting feeds. This makes it possible to achieve a regular alternating linking of the knitting needles in all knitting feeds of the knitting machine, and thus the production of regular courses in the knit work.

A further advantage of the invention is that the lateral adjustment of the cams can be carried out even during operation of the knitting machine, thereby making it possible to follow the operation of the machine visually.

An exemplary form of the device of the present invention is shown in the accompanying drawings, in which.

Figure 2:
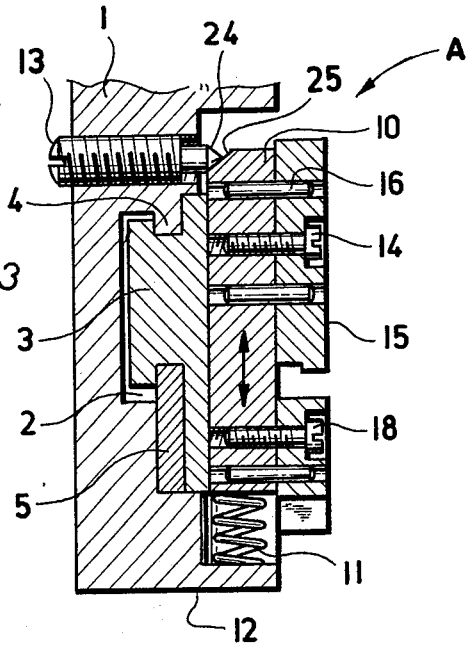
FIG. 2 is a view in vertical section through such assembly, the section being taken along the line 2—2 of FIG. 1.
Figure 3:
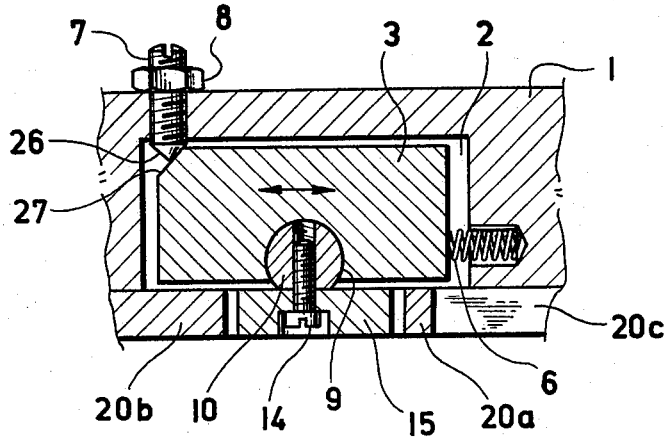
FIG. 3 is a view in horizontal section through the cam assembly of FIG. 1, the section being taken along the line 3—3 of FIG. 1.

The cam assembly shown in the drawings is designated generally by the reference A. The cam assembly frame plate 1 of the assembly A is provided with a prismatic recess 2 in which there is disposed a first slide or block 3 which is slidably laterally adjustable in the direction of the double ended arrow in FIG. 3. The block 3 is secured against falling out of the recess 2 by a longitudinal projection 4 at the upper side of the recess (FIG. 2) and by a batten 5 at the lower end of the recess, the batten being fastened to the cam assembly frame plate 1 as by machine screws (not shown). The sliding block 3 is constantly thrust to the left (FIG. 3) by a coil compression spring 6 which is mounted in a spring seat in the member 1, the block 3 being provided on its rear corner opposite the spring 6 with a beveled surface 27 forming an adjusting cam follower which engages the conical end 26, forming an adjusting cam, of an adjusting screw 7 threadedly mounted in the member 1 so as to stand into the recess 2. It will be apparent that the screwing of the set screw 7 downwardly in FIG. 3 will thrust the block 3 to the right, and that the unscrewing of screw 7 will permit the block 3 to be thrust to the left by the spring 6. The screw 7 is held in adjusted position by lock nut 8. Instead of the screw 7 and the spring 6, the block 3 may be adjusted laterally by means (not shown) including an eccentric pin rotatably mounted in the assembly plate 1, the inner end of the eccentric pin engaging a groove (not shown) in the sliding block 3.

A vertically extending circular cylindrical passage or bore 9 is provided in the forward or outer portion on the block 3, such bore 9 being partially opened to the forward face of the block. A generally circular cylindrical bar or pin 10 is slidably mounted in the bore 9, the pin 10 which functions as a second slide, being constantly urged in an upward direction by coil compression spring 11 which abuts a ledge 12 on the plate member 1 at its bottom end and abuts the lower end of the pin 10 at its upper end. The upper end of the pin 10 is provided with a beveled surface 25, forming an adjusting cam follower, which is engaged by the conical inner end 24, forming an adjusting cam, of an adjusting screw 13 threaded into the plate 1. It will be apparent that the spring 11 constantly thrusts the pin 10 upwardly so that the surface 25 on the pin engages the end 24 on the screw 13. Turning of the screw so as to advance it to the right in FIG. 2 adjusts the pin 10 downwardly; retraction of the screw in the opposite direction permits the pin 10 to rise to an upper different adjusted position.

A stitch cam 15 is fastened to the pin 10 by means of a screw 14, cam 15 being further secured to the pin 10 by means of pins 16. A stop cam 17 is secured to the pin 10 by another screw 18 and a screw secured thereto by a further pin 19. On the entrance side of the cams 15, 17, there are positioned upper and lower stop cams 20*a* and 20*c* respectively and at the opposite side of the cams 15 and 17 there are secured upper and lower stop parts 20*b* and 20*d* respectively. All of such parts 20 are secured to the plate 1 by means not shown.

Figure 1:
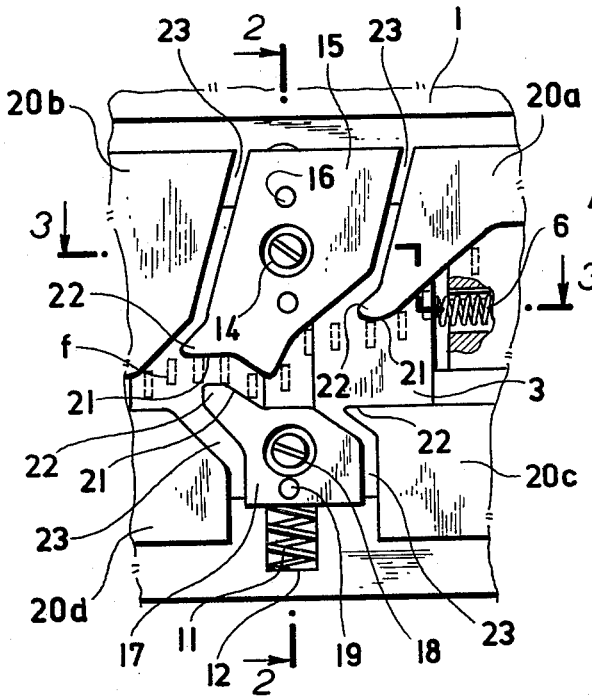
FIG. 1 is a view in front elevation of the cam assembly with its cams.

Stitch cam 15, stop cam 17 and stop parts 20*a* – 20*d* are provided with active surfaces 21 which cooperate with feet or butts *f* on the knitting needles or the knitting needle jacks (neither of which is shown) of the knitting machine to secure the usual operation of the knitting needles. The feet or butts *f* travel in the direction from right to left (FIG. 1) with respect to the stationary cams as indicated by the arrow. In view of the lateral adjustability of the cams, i.e., the stitch cam 15 and the stop cam 17, the active surfaces 21 also extend to the projections 22 provided on the stitch cam 15 and the stop cam 17, and also on the stop parts 20*a* – 20*d* that the gaps 23 between the stitch cam 15 and the neighboring stop parts 20, as well as between the stop cam 17 and the neighboring further stop parts 20, are covered for the purpose of preventing jamming or breaking of the needle butts or shafts.

After the assembly of the knitting machine, the lateral and vertical adjustment of the cams 15, 17, is effected during operation of the knitting machine. Such lateral adjustment eliminates the manufacturing deviations in the angular layout of the knitting feeds by the turning of the screw 7 in the proper direction so as to adjust the sliding block 3 laterally, with respect to the prismatic recess 2 in the cam assembly plate 1. Such lateral adjustment of the block 3 effects the lateral adjustment of the stitch cam 15 and the stop cam 17 which are attached to the block 3. After perfect lateral adjustment of the block 3 has been secured, which adjustment is confirmed by visual observation, the lock nut 8 is tightened. The cams 15 and 17 are adjusted in height by the turning of the screw 13 in the proper direction, as above described. It is to be understood that such adjustment is possible only when the device of the present invention is applied to a knitting machine with a stationary cam box.

The present invention can advantageously be used in multi-feed knitting machines with a fine needle bed guage.

The invention is illustrated and described with a reference to a preferred embodiment thereof and it is to be understood that it is in no way limited to said preferred embodiment but is capable of numerous modifications according to the appended claims.

What is claimed is:

1. A supporting device for the needle cams on knitting machines having a plurality of knitting needles controlled by the needle cams, comprising a supporting frame member, a first slide mounted on the frame member for adjustment along a first path transverse to the knitting stroke of the needles, means for adjusting the first slide along said first path, a stitch cam, means mounting the stitch cam on the first slide for adjustment with respect thereto along a second path parallel to the knitting stroke of the knitting needles, said last named means comprising a passage in the first slide parallel to said second path, a second slide slidably mounted in said passage, the stitch cam being secured to the second slide, and means for adjusting the second slide with respect to the first slide along said second path, the means for adjusting the first slide along said first path and the means for adjusting the second slide with respect to the first slide being accessible to an operator and adjustable by him during the operation of the knitting machine, the means to adjust the first slide relative to the frame member comprising an adjusting cam and an adjusting cam follower means mounted on said first slide acting between the frame member and the first slide.

2. A device according to claim 1, wherein the adjusting cam is mounted on the frame member.

3. A device according to claim 2, wherein the adjusting cam comprises a screw disposed perpendicularly to said first path threaded into the frame member and having a conical free end, wherein there is a prismatic recess in the frame member extending parallel to said first path, the first slide having a part mounted in said recess, the cam follower means is a bevel surface on the first slide engaging the conical end of the screw, and wherein there is a means constantly urging the said bevel surface of the first slide into engagement with said conical end of the screw.

* * * * *